United States Patent [19]

Barrat et al.

[11] 4,285,841

[45] Aug. 25, 1981

[54] HIGHLY CONCENTRATED FATTY ACID CONTAINING LIQUID DETERGENT COMPOSITIONS

[75] Inventors: Christian R. Barrat, Meise; Jean Wevers, Mazensele; Robertus J. C. Koster, Grimbergen, all of Belgium

[73] Assignee: The Procter & Gamble Company, Cincinnati, Ohio

[21] Appl. No.: 148,615

[22] Filed: May 12, 1980

[30] Foreign Application Priority Data

May 16, 1979 [GB] United Kingdom ..... 17133/79

[51] Int. Cl.[3] ..... C11D 1/12

[52] U.S. Cl. ..... 252/559; 252/174.12; 252/174.19; 252/174.21; 252/527; 252/540; 252/546; 252/DIG. 12; 424/94

[58] Field of Search ..... 252/174.12, 174.19, 252/174.21, DIG. 12, 527, 540, 546, 559; 424/94

[56] References Cited

U.S. PATENT DOCUMENTS

| | | | |
|---|---|---|---|
| 4,111,855 | 9/1978 | Barrat et al. | 252/174.12 |
| 4,142,999 | 3/1979 | Bloching et al. | 252/DIG. 12 |

FOREIGN PATENT DOCUMENTS

| | | |
|---|---|---|
| 2369338 | 10/1977 | France . |
| 2389672 | 5/1978 | France . |
| 1370402 | 10/1974 | United Kingdom . |

*Primary Examiner*—Mayer Weinblatt

[57] ABSTRACT

Builder-free highly concentrated homogeneous fatty acid containing liquid detergent compositions are disclosed. The surface-active system in addition to the fatty acids also contains substantial amounts of anionic sulfonate/sulfate detergents and nonionic ethoxylates. The compositions are mildly acid to neutral and are capable of providing unexpectedly superior textile cleaning benefits, especially on oily and bleach sensitive soils.

12 Claims, No Drawings

HIGHLY CONCENTRATED FATTY ACID CONTAINING LIQUID DETERGENT COMPOSITIONS

This invention relates to builder-free highly concentrated homogeneous liquid detergent compositions containing substantial amounts of fatty acids. The compositions herein additionally comprise a major amount of an anionic sulfonate and/or sulfate surfactant and a relatively minor level of a nonionic ethoxylate surfactant. Preferred executions of these compositions additionally contain low levels of proteolytic detergent enzymes and possibly organophosphonic acids or the salts thereof. The subject compositions are particularly suitable for the cleaning of textiles in lieu of conventional heavy duty detergents for usage at medium to low laundry temperatures. The normal use of the compositions herein in laundry operations yields excellent cleaning especially with respect to oily and bleach sensitive soils.

The prior art relative to liquid detergent compositions on basis of multicomponent surface-active systems inclusive of soaps and nonionics is crowded and diverse. French Pat. No. 2,170,037 pertains to adjuvant-free liquid detergents containing a major amount of a nonionic ethoxylate surfactant, a relatively minor level of an alkylbenzenesulfonic acid salt, a fatty acid/soap, an organic solubilizing agent and optionally a low level of water. The '037 compositions are formulated with a view to provide physically and chemically stable mixtures which are not adversely affected by cloudiness, gel-formation, phase-separation and other stability phenomena. Belgian Pat. No. 857,144 relates to alkaline concentrated liquid detergents containing a combination of nonionic ethoxylates, soaps, amylolytic and/or proteolytic enzymes and alkoxylated alkylamines. French Pat. No. 2,839,672 relates to substantially alkaline liquid detergents containing a major amount of a soap, a relatively minor amount of an organic synthetic surfactant and an alkaline buffering agent.

Concentrated enzyme containing alkaline liquid detergents are also known from French Pat. No. 2,369,338. These compositions contain a soap, a major amount of a nonionic ethoxylate and a lower level of an anionic detergent.

Published Dutch Patent Application No. 74,03258; Belgian Pat. No. 812,210; U.S. Pat. Nos. 3,663,445 and 2,857,153; German Patent Application Nos. DOS 26 09 752; DOS 23 02 367 and DOS 23 04 098; and French Pat. No. 2,320,928 all disclose liquid alkaline detergent compositions containing substantial amounts of soap, nonionic ethoxylate surfactants, frequently additional anionic surfactants and conventional additives inclusive of detergent enzymes.

The prior art recognizes the multiple difficulties flowing from the incorporation of substantial to high amounts of soaps in, possibly concentrated, liquid detergents. These deficiences were overcome through: (1) the utilization of high levels of nonionic ethoxylates which facilitate the storage-stable dissolution of soaps; (2) the prevalent use of alkaline conditions, aiming at the beneficial utilization of the wetting properties of soap (vs. fatty acid); (3) the use of relatively low levels of synthetic anionic detergents to thus avoid precipitation, cloudiness, gel-formation and the like phase stability deficiencies which are frequently associated with these anionic detergents.

The alkalinity of the soap containing liquid detergents of the prior art also serves to optimize detergency, particularly at high levels and to avoid processing difficulties.

In general the soap containing liquid detergents of the art can provide under specific laundry conditions cleaning benefits on limited types of soils.

It is a major object of this invention to formulate homogeneous builder-free concentrated liquid detergents containing substantial amounts of fatty acids and anionic synthetic surfactants and a relatively minor amount of nonionic ethoxylates, said composition having a mildly acid to substantially neutral pH.

It is a further object of this invention to provide concentrated aqueous fatty acid containing detergents capable of providing superior performance over a broad range of different soils at low and medium machine-cycle temperatures, such as up to 60° C.

It is yet another object of this invention to formulate a builder-free concentrated liquid detergent capable of providing superior cleaning performance under non-alkaline laundry conditions.

The above and other advantages are now achieved with the aid of the compositions of this invention as described in more detail hereinafter.

It was found that highly concentrated fatty acid containing homogeneous substantially builder-free liquid detergents can be formulated which are excellently suitable for the cleaning of textiles, especially for washing machine laundering. These compositions comprise from about 35% to about 75% by weight of a ternary active system consisting essentially of:

(a) an anionic synthetic surface-active salt selected from the group of sulfonates and sulfates;
(b) an ethoxylated nonionic surface-active agent; and
(c) from about 8% to about 20% by weight of the composition of a fatty acid having about 10 to 22 carbon atoms;

whereby the weight ratio of (a) to (b) is in the range from about 10:1 to 1:1, and the total amount (wt %) of (a)+(b) is greater than the total amount (wt %) of (c), said composition having a pH at 20° C. in the range of from 6.0 to 7.5;

(d) a phase regulant, and water.

The preferred anionic synthetic surfactant is represented by an alkyl benzene sulfonate trietholamine salt. Preferred fatty acids have from about 16 to 18 carbon atoms and are comprised of at least 30% by weight of unsaturated species. Other preferred fatty acids are represented by a saturated $C_{10}$–$C_{14}$ fatty acid, oleic acid or a mixture thereof in a ratio (weight) of from 2:1 to 1:3.

In a preferred embodiment, the compositions herein comprise low levels of proteolytic detergent enzymes and of alkylene-polyamino-polyalkylene phosphonic acids or the salts thereof.

The builder-free concentrated liquid detergent compositions of this invention contain critical levels of a ternary active system, are substantially non-alkaline, and are prepared with the aid of a solvent system comprised of a phase regulant and water. Each of the individual formulation parameters is explained and described in more detail hereinafter.

Unless indicated to the contrary, the "%" indications stand for "percent by weight".

The highly concentrated builder-free compositions herein comprise from about 35% to 75%, preferably from about 45% to about 65% by weight of a ternary active system comprised of an anionic synthetic surface-active salt selected from the group of sulfonates and sulfates, an ethoxylated nonionic surface-active agent, and a fatty acid having from about 10 to 22 carbon atoms.

Suitable anionic synthetic surface-active salts are selected from the group of sulfonates and sulfates. The like anionic detergents are eminently well-known in the detergent arts and have found wide-spread application in commercial detergents. Preferred anionic synthetic watersoluble sulfonate or sulfate salts have in their molecular structure an alkyl radical containing from about 8 to about 22 carbon atoms. Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 8 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880, incorporated herein by reference, can also be used. The neutralizing cation for the anionic synthetic sulfonates and/or sulfates is represented by conventional cations which are widely used in detergent technology such as sodium, potassium, lithium, amines and substituted amines. Preferred are mono-, di-and tri-ethanol amines.

A particularly preferred anionic synthetic surfactant component herein is represented by the water-soluble salts of an alkylbenzene sulfonic acid, preferably an alkanolamine alkylbenzene sulfonate having from about 10 to 13 carbon atoms in the alkyl group. Preferred are the triethanolamine salts.

Another essential component in the ternary active system is an ethoxylated nonionic surface-active agent. The nonionic detergent component contains a hydrophobic organic radical condensed with an ethyleneoxide hydrophilic moiety. All ethoxylated nonionic surfactants which are known to be suitable for use in detergent application can be used in the compositions of this invention. Preferred nonionic species herein are polyethoxylates derived from primary and secondary aliphatic alcohols having from 8 to about 24 carbon atoms, and having a HLB (hydrophilic-liphilic balance) in the range from about 9 to 15. These preferred ethoxylates frequently contain from 2 to about 14 moles of ethylene oxide per mole of hydrophobic moiety. The hydrocarbyl chain (hydrophobic moiety) can be represented by linear or branched fatty alcohols.

A preferred class of nonionic ethoxylates is represented by the condensation product of a fatty alcohol having from 12 to 15 carbon atoms and from about 4 to 10 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty (oxo) alcohol; the condensation product of a narrow cut $C_{12}$–$C_{13}$ fatty (oxo) alcohol and 6.5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo-alcohols.

Preferred nonionic ethoxylated components can also be represented by a mixture of 2 separately ethoxylated nonionic surfactants having a different degree of ethoxylation. For example, the nonionic ethoxylate can be represented by mixtures of a first ethoxylated surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

The third essential ingredient in the ternary active system is represented by a fatty acid having from about 10 to 22 carbon atoms. The fatty acid component represents from about 8% to about 20%, preferably from 10% to 15% by weight of the composition. Using less than about 8% will not show anymore the significant performance benefits of the compositions herein. Increasing the level of fatty acid above about 20% can give rise to processing difficulties.

Suitable fatty acids are saturated or unsaturated and can be obtained from natural sources such as, for example, plant or animal esters (e.g. palm oil, coconut oil, babassu oil, safflower oil, tall oil, castor oil, tallow and fish oils, grease, and mixtures thereof) or can be synthetically prepared for example via the oxidation of petroleum or by hydrogenation of carbon monooxide via the Fisher-Tropsch process. Examples of suitable saturated fatty acids for use in the compositions of this invention include capric, lauric, myristic, palmitic, stearic, arachidic and behenic acid. Suitable unsaturated fatty acid species include: palmitoleic, oleic, linoleic, linolenic and ricinoleic acid. Highly preferred for use herein are fatty acids having from 16 to 18 carbon atoms and which are comprised of at least 30% of unsaturated species. Other preferred fatty acids are represented by a mixture of saturated $C_{10}$–$C_{14}$ (coconut) fatty acids and oleic acid in a ratio (weight) of from 2:1 to 1:3.

The individual ingredients of the ternary active system shall be used in specific narrowly defined ratios (wt). For a variety of reasons inclusive of processing and overall cleaning performance the ratios are critical with a view to achieve the full inventive advantages. The ratio of anionic surface-active sulfonate and/or sulfate salt to ethoxylated nonionic surface-active agent is in the range from about 10:1 to 1:1, preferably from 4:1 to 1.5:1. Additionally the ratio (wt) of the total amount (weight %) of the anionic surfactant salt+the ethoxylated nonionic is greater than the total amount (wt %) of fatty acid. Preferably, this ratio (total amount of anionic+nonionic to fatty acid) varies in the range from 2:1 to 5:1.

The compositions of this invention are further characterized by a pH, as is, between 6.0 and 7.5, preferably between 6.5 and 7.2. At a composition pH of less than about 6.0 the homogeneous liquid compositions can suffer preparational instability. Increasing the composition pH above 7.5 adversely affects the removal of bleachable soils. The term "as is" defined herein represents the pH measured at about 20° C. on the claimed concentrated composition. The pH of the compositions herein can be adjusted with the aid of suitable neutralizing or buffering agents. Preferred are alkanolamines such as triethanolamines.

The phase regulant is a further essential ingredient in the compositions herein. This component together with water constitutes the solvent matrix for the claimed concentrated liquid compositions. While the sum of the phase regulant and water is generally in the range from 65% to 25% the phase regulant is used in an amount from about 5% to 20%. The phase regulant facilitates the manufacturing of the concentrated compositions herein departing from the raw materials and also provides additional storage stability during periods of prolonged storage, particularly at subambient temperatures. Phase regulants for utilization in the claimed liquid detergent compositions are well-known in this domain of technology. Suitable ingredient classes include lower aliphatic alcohols having from 2 to 6 carbon atoms and from 1 to 3 hydroxyl groups, ethers of diethyleneglycol and lower aliphatic monoalcohols having from 1 to 4 carbon atoms. Specific examples of phase regulants are: ethanol; n-propanol; isopropanol; butanol; 1,2-propanediol; 1,3-propanediol; n-hexanol; monomethyl-,-ethyl-,-propyl-, and mono-butyl ethers of di-ethylene glycol. Additional phase regulants having a relatively high boiling point and low vapor pressure can also be used provided they do not react with the other ingredients of the compositions.

Known detergent hydrotropes are a further class of phase regulants suitable for use herein. Examples of these hydrotropes include salts of alkylarylsulfonates having up to 3 carbon atoms in the alkylgroup e.g. sodium, potassium, ammonium and ethanolamine salts of xylene-, toluene-, ethylbenzene:, cumene-, and isopropylbenzene sulfonic acids.

In addition to the essential ingredients described hereinbefore, the compositions herein frequently contain a series of optional ingredients which are used for their known functionality in conventional quantities, usually below about 5%. Examples of the like additives include: enzymes, polyacids, suds regulants, opacifiers, antioxidants, bactericides, dyes, perfumes, brighteners and the like.

Detergent enzymes generally aid and augment the removal of specific stains. Suitable enzymes can be represented by proteases, amylases, lipases, glucose oxidases or mixtures thereof. Proteases are preferred in the claimed liquid concentrated compositions. They are frequently employed in a level from about 0.01% to about 1%.

Another preferred additive is represented by a polyacid or mixture of polyacids in an amount from about 0.05% to about 2%. Suitable polyacids are those having one pK value of at least 5.5. The pK is measured at a temperature of the water in the range from about 10° C. to 30° C. Suitable polyacids can include: ascorbic, aspartic, citric, cyclohexane-1,1-dicarboxylic, cyclopropane-1,1-dicarboxylic, dimethylmalic, glutaric, o-hydroxybenzoic, m-hydroxybenzoic, p-hydroxybenzoic, itaconic, maleic, malic, methylsuccinic, o-phthalic, succinic, o-phosphoric, pyrophosphoric, and nitrilotriacetic acid. Preferred polyacid species for use herein can also be represented by organo-phosphonic acids, particularly alkylene-polyamino-polyalkylene phosphonic acids such as ethylene diamine tetramethylenephosphonic acid, hexamethylene diaminetetramethylenephosphonic acid, diethylene triaminepentamethylenephosphonic acid, and aminotrimethylenephosphonic acid or the salts thereof. These organophosphonic acids/salts are preferably used in an amount from 0.1%–0.8%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicone. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The compositions herein can also contain known antioxidants for their known utility, frequently radical scavengers, in the art established levels i.e. 0.001% to 0.25% (by reference to total composition). These antioxidants are frequently introduced in conjunction with the fatty acid, especially the unsaturated fatty acid. While many suitable antioxidants are readily known and available for that purpose especially preferred for use in the compositions herein are: 2,6 ditertiary butyl-p-cresol, more commonly known as butylated hydroxytoluene, BHT, and 2-tertiarybutyl-4-hydroxyanisole or 3-tertiarybutyl-4-hydroxyanisole more commonly known as BHA or butylated hydroxyanisole. Other suitable antioxidants are: 4,4'thiobis(6-tert-butyl-m-cresol) and 2-methyl-4,6-dinonyl phenol.

The following examples illustrate the invention and facilitate its understanding.

Liquid detergent compositions were prepared by mixing the individual ingredients listed hereinafter in the stated proportions.

| Ingredients | Composition A | Example I |
|---|---|---|
| Linear dodecylbenzene sulfonate triethanolamine salt | 15 | 30 |
| Condensation product of $C_{13}$–$C_{15}$ oxo-alcohol and 7 moles of ethylene oxide per mole fatty alcohol | 30 | 15 |
| Tallow fatty acid* | 15 | 15 |
| Citric acid | 0.2 | 0.2 |
| Diethylenetriamine pentamethylene phosphonic acid | 0.3 | 0.3 |
| Alkaline protease** | 0.05 | 0.05 |
| Stilbene brightener | 0.25 | 0.25 |
| Silicone emulsion (DB 110 ex-Dow Corning) | 0.2 | 0.2 |
| Ethanol | 10 | 10 |
| 1,2-propanediol | 5 | 5 |
| Triethanolamine | To adjust pH of Composition to 7 | |
| Water | Balance to 100 | |

*Fatty acid chain distribution: 25% palmitic, 19% stearic, and 42% oleic acid
 Maxatase® supplied by Gist-Brocades, expressed on 100% active basis The above compositions were used for comparative laundry tests. A MIELE W422 washing machine equipped with a 60° C. heat-up cycle was used thereby selecting a main-wash step with a low water level. Cotton and polyester/cotton strips stained as indicated below were used to measure the comparative performance. Additional testing parameters were: product usage 120 g/20 l. of city water having an average water hardness of about 3 mmoles/l.; laundering treatment in presence of 3 kgs soiled cloths (no-pretreatment on test strips); stains: greasy type i.e. make-up, shoe-polish, and dirty motor oil (DMO); bleachable type: tea, wine and blueberry.

After having been subjected to the above washing treatment the dried stained cotton strips were visually graded by two expert judges thereby using a 0–4 scale whereby:

0=see no difference between the swatches
1=believe there is a difference between the swatches
2=there is a difference between the swatches
3=am sure there is a difference between the swatches
4=very important difference between the swatches.

The stain removal readings were pooled and averaged on 8 replicates with the following results. The swatches treated with prior art composition A were used for reference purposes:

| STAIN | EXAMPLE I COTTON | EXAMPLE I POLYESTER/COTTON |
|---|---|---|
| make-up | +1.0 | +0.2 |
| shoe-polish | +0.8* | +0.4 |
| DMO | +2.4* | +2.5* |
| tea | +1.0* | +1.1* |
| wine | +0.5* | 0 |
| blueberry | +2.2* | −0.4 |

*results statically significant at 95% confidence limit;
+means that Example I is preferred over composition A.

These testing results confirm the consistent superiority of the composition of Example I in accordance with this invention versus prior art composition A.

Substantially identical performance is obtained from a composition wherein the tallow fatty acid is replaced by an equivalent level of hydrogenated coconut fatty acid.

Concentrated liquid detergent compositions were prepared by mixing the indicated ingredients in the stated proportions.

| Ingredients | Composition B | Ex. II | Ex. III |
|---|---|---|---|
| Linear dodecylalkybenzene sulfonate triethanolamine salt | 45 | 38.5 | 30 |
| Condensation product of $C_{13}$–$C_{15}$ oxo-alcohol and 7 moles of ethylene oxide per mole fatty alcohol | — | 6.5 | 15 |
| Tallow fatty acid* | 15 | 15 | 15 |
| Citric acid | 2.0 | " | " |
| Diethylenetriamine pentamethylene phosphonic acid | 0.3 | " | " |
| Alkaline protease** | 0.05 | " | " |
| Stilbene brightener | 0.25 | " | " |
| Silicone emulsion (DB 110 ex-Dow Corning) | 0.2 | " | " |
| Ethanol | 10 | " | " |
| 1,2-propanediol | 5 | " | " |
| Triethanolamine | To adjust pH of Composition to 7 | | |
| Water | Balance to 100 | | |

*Fatty acid chain distribution: 25% palmitic, 19% stearic, and 42% oleic acid
**Maxatase® supplied by Gist-Brocades, expressed on 100% active basis The testing conditions were identical to those described in Example I hereinbefore.

The stain removal readings were pooled and averaged on 8 replicates with the following results. Swatches treated with composition B were used for reference purposes.

| STAIN | EXAMPLE II COTTON | EXAMPLE II POLYESTER/COTTON | EXAMPLE III COTTON | EXAMPLE III POLYESTER/COTTON |
|---|---|---|---|---|
| Make-up | +2.1* | +1.8* | +1.9* | +1.6* |
| Shoe-polish | +0.7 | +0.9* | +0.7 | +0.8* |
| DMO | +2.0* | +1.0* | +3.1* | +2.1* |
| Tea | −0.3 | +0.2 | +0.7 | +0.6 |
| Wine | −0.4 | 0 | 0 | 0 |
| Blueberry | −0.3 | 0 | +1.1 | 0 |

*Readings statistically significant at 95% confidence limit
+means that relevant example composition is preferred over composition B These comparative results confirm the performance superiority of the claimed compositions vs. a composition containing high levels of anionic detergent and fatty acid.

A series of additional compositions of this invention are prepared by mixing the ingredients hereinafter in the listed proportions.

| INGREDIENTS | IV | V | VI | VII | VIII | IX | X |
|---|---|---|---|---|---|---|---|
| Linear dodecylbenzene sulfonate triethanolamine salt | 25 | 30 | 40 | 25 | 25 | 40 | 30 |
| Condensation product of $C_{13}$–$C_{15}$ oxo-alcohol and 7 moles of ethylene oxide per mole of alcohol | 16 | 15 | 18 | — | 20 | 10 | 15 |
| Condensation product of one mole of $C_{14}$–$C_{15}$ oxo-alcohol and 4 moles of ethylene oxide | — | — | — | 8 | — | — | — |
| Condensation product of one mole highly (60%) branched $C_{16}$–$C_{19}$ oxo-alcohol and 11 moles of EO | — | — | — | 12 | — | — | — |
| Tallow fatty acid | — | 12.5 | 15 | — | 12.5 | 12.5 | 12.5 |
| Hardened coconut fatty acid | 7.5 | — | — | 8 | — | — | — |
| Oleic acid | 7.5 | — | — | 8 | 3.0 | — | — |
| Silicone emulsion | 0.2 | 0.3 | 0.1 | 0.1 | 0.2 | 0.2 | 0.2 |
| Alkaline protease | 0.05 | 0.05 | 0.05 | 0.05 | 0.05 | 0.05 | 0.05 |

-continued

| INGREDIENTS | EXAMPLES IV | V | VI | VII | VIII | IX | X |
|---|---|---|---|---|---|---|---|
| Citric acid | 0.4 | 0.2 | 0.8 | 0.5 | 0.5 | 0.4 | 0.5 |
| Diethylenetriaminepenta-methylene phosphonic acid | 0.3 | 0.6 | 0.6 | 0.3 | 0.3 | 0.4 | 0.4 |
| 4,6-dinonyl-O-cresol | 0.01 | 0.01 | — | — | 0.01 | 0.01 | 0.01 |
| BHT-antioxidant | — | — | 0.01 | 0.02 | — | — | — |
| Ethanol | 10 | 10 | 8 | 10 | 10 | 5 | 10 |
| 1,2-propanediol | — | 5 | 5 | 5 | — | 10 | 5 |
| Toluene sulfonic acid | — | — | — | — | — | 2 | — |
| Triethanolamine to adjust to pH: | 7 | 6.5 | 7 | 6.8 | 7 | 7 | 7 |
| Water and minors, such as brighteners, dyes, perfumes, opacifiers | | | balance to 100% | | | | |

We claim:

1. A highly concentrated homogeneous liquid detergent composition comprising (a) from about 35% to about 75% by weight of a ternary active system consisting essentially of:

(i) anionic synthetic surface-active salt selected from the group consisting of sulfonates and sulfates having an alkyl radical containing from about 8 to about 22 carbon atoms and wherein the neutralizing cation is selected from the group consisting of sodium, potassium, lithium, amines and substituted amines;

(ii) ethoxylated nonionic surface-active agent derived from alcohols having from 8 to 24 carbon atoms and having from 2 to about 14 moles of ethylene oxide per mole of hydrophobic moiety;

(iii) from about 8% to about 20% by weight of the composition of fatty acid having from about 10 to 18 carbon atoms;

(b) phase regulant which is selected from the group consisting of lower aliphatic alcohols having from 2 to 6 carbon atoms and 1 to 3 hydroxyl groups, esters of diethylene glycol and lower aliphatic monoalcohols having from 1 to 4 carbon atoms, and detergent hydrotropes; and water; wherein the weight ratio of (i) to (ii) is in the range from about 10:1 to 2:1, and the total amount (weight %) of (i)+(ii) is greater than the total amount (weight %) of (iii), said composition having a pH at 20° C. in the range of from 6.0 to 7.5.

2. The composition in accordance with claim 1 wherein the anionic synthetic surfactant is represented by an alkyl benzene sulfonate having from about 9 to about 15 carbon atoms in the alkyl chain and whereby the neutralizing cation is selected from mono-, di-, and tri-ethanol amine.

3. The composition in accordance with claim 1 wherein the nonionic surface-active agent has a HLB in the range of from about 9–15.

4. The composition in accordance with claim 1, wherein the fatty acid has from about 16 to 18 carbon atoms and includes at least 30% by weight of unsaturated fatty acid.

5. The composition in accordance with claim 1 wherein the nonionic ethoxylate is a condensation product of a fatty alcohol having from 10 to 15 carbon atoms and from 4 to 10 moles of ethylene oxide per mole fatty alcohol.

6. The composition in accordance with claim 1 wherein the weight ratio of the total amount of (i)+(ii) to the total amount of (iii) is in the range from 2:1 to 5:1.

7. The detergent composition in accordance with claim 1 wherein the ternary active system represents from about 45% to about 60% by weight.

8. The composition in accordance with claim 1 wherein the phase regulant represents from about 8% to about 20% by weight.

9. The composition in accordance with claim 1 which in addition contains a dimethylpolysiloxane suds regulant in an amount from 0.01% to 0.2% by weight.

10. The composition in accordance with claim 1 which in addition contains antioxidant selected from the group consisting of butylated hydroxytoluene, butylated hydroxyanisole, 4,4'-thiobis(6-tert-butyl-m-cresol) and 2-methyl-4,6-dinonyl phenol, said antioxidant being present in an amount from 0.001% to 0.25% by weight.

11. The composition in accordance with claim 1 which additionally contains from 0.01% to about 1% by weight of a detergent enzyme selected from the group of proteases, amylases, lipases, glucose-oxidases and mixtures thereof; and from about 0.05% to about 2% by weight of a polyacid which is a member selected from the group consisting of ascorbic acid, aspartic acid, citric acid, cyclohexane-1,1-dicarboxylic acid, cyclopropane-1,1-dicarboxylic acid, dimethylmalic acid, glutaric acid, o-hydroxybenzoic acid, m-hydroxybenzoic acid, p-hydroxybenzoic acid, itaconic acid, maleic acid, malic acid, methylsuccinic acid, o-phthalic acid, succinic acid, o-phosphonic acid, pyrophosphonic acid, nitrilotriacetic acid, ethylenediaminetetramethylene phosphonic acid, hexamethylenediamine tetramethylene phosphonic acid, diethylenetriaminepentamethylene phosphonic acid, and aminotrimethylenephosphonic acid, and the salts thereof, and is present in an amount of from 0.05% to about 2% by weight.

12. The composition in accordance with claim 1 wherein fatty acid is present in an amount ranging from about 12.5% to about 16% by weight of the composition.

* * * * *